US008143990B2

(12) United States Patent
Kowalik

(10) Patent No.: US 8,143,990 B2
(45) Date of Patent: Mar. 27, 2012

(54) MICRO-FLUIDIC BUBBLE FUSE

(76) Inventor: Daniel Kowalik, Orchard Park, NY (US)

( * ) Notice: Subject to any disclaimer, the term of this patent is extended or adjusted under 35 U.S.C. 154(b) by 0 days.

(21) Appl. No.: 12/760,599

(22) Filed: Apr. 15, 2010

(65) Prior Publication Data

US 2010/0201475 A1 Aug. 12, 2010

Related U.S. Application Data

(63) Continuation of application No. PCT/US2008/081245, filed on Oct. 27, 2008.

(60) Provisional application No. 61/000,546, filed on Oct. 26, 2007.

(51) Int. Cl.
*H01H 87/00* (2006.01)
*H01H 29/00* (2006.01)
*H01H 37/36* (2006.01)

(52) U.S. Cl. ..... 337/21; 337/80; 337/114; 337/167; 337/331; 335/47; 29/623

(58) Field of Classification Search ..... 337/21, 337/80, 114, 167, 331; 29/623; 335/47
See application file for complete search history.

(56) References Cited

U.S. PATENT DOCUMENTS 2,387,313 A * 10/1945 Wilson, Jr. ..... 200/190
2,713,726 A * 7/1955 Dixson ..... 33/366.21
2,720,569 A * 10/1955 Schoeppel et al. ..... 200/193
2,830,159 A * 4/1958 Varner ..... 200/193
2,977,559 A * 3/1961 Rosenberg et al. ..... 338/44
3,020,506 A * 2/1962 Remington et al. ..... 338/86
3,177,327 A * 4/1965 Weiss ..... 200/211
3,208,023 A * 9/1965 Polye ..... 338/44
3,341,676 A * 9/1967 Schwarz ..... 200/211
3,818,409 A * 6/1974 Pastors et al. ..... 337/273
3,955,059 A * 5/1976 Graf ..... 200/181
4,371,753 A * 2/1983 Graf ..... 379/259
4,761,708 A * 8/1988 Ficken ..... 361/212
5,471,185 A * 11/1995 Shea et al. ..... 335/51

(Continued)

FOREIGN PATENT DOCUMENTS

EP 950979 A1 * 10/1999

(Continued)

OTHER PUBLICATIONS

International Search Report and Written Opinion of the International Searching Authority from corresponding PCT application PCT/US2008/081245.

*Primary Examiner* — Bradley Thomas
(74) *Attorney, Agent, or Firm* — Anderson Gorecki & Manaras LLP

(57) ABSTRACT

A microfluidic bubble fuse is formed from a hermetically sealed reservoir containing an electrically conductive liquid. The reservoir is interposed between a pair of electrodes such that each electrode is in electrical contact with the fluid within the reservoir, and such that the fluid within the reservoir provides electrical interconnectivity between the electrodes. The reservoir may be implemented on a substrate, in a tube, or in another manner. When the current or voltage across the electrodes increases beyond a threshold, the excess current or voltage will cause a bubble to be created within the fluid to reduce or inhibit the flow of electricity between the electrodes. When the current/voltage is reduced, the bubble will collapse to restore the flow of electricity between the electrodes.

17 Claims, 8 Drawing Sheets

U.S. PATENT DOCUMENTS 5,581,192 A * 12/1996 Shea et al. ..... 324/722
6,454,924 B2 * 9/2002 Jedrzejewski et al. ..... 204/601
6,525,642 B1 * 2/2003 Kremers et al. ..... 338/80
6,600,405 B1 * 7/2003 Kremers et al. ..... 337/21
6,603,384 B1 8/2003 Kremers et al.
6,621,401 B1 * 9/2003 Kremers et al. ..... 337/21
6,632,400 B1 * 10/2003 Brennen et al. ..... 422/82.01
6,714,115 B1 * 3/2004 Kremers et al. ..... 337/21
6,720,507 B2 * 4/2004 Wong et al. ..... 200/182
6,765,162 B2 * 7/2004 Wong et al. ..... 200/182
6,797,901 B2 * 9/2004 Kondoh et al. ..... 200/187
6,850,145 B1 * 2/2005 Kremers et al. ..... 337/21
6,877,528 B2 * 4/2005 Gilbert et al. ..... 137/827
6,884,951 B1 * 4/2005 Wong ..... 200/182
6,939,451 B2 * 9/2005 Zhao et al. ..... 204/451
7,139,158 B2 * 11/2006 Niayesh et al. ..... 361/93.9
7,315,228 B2 * 1/2008 Dooley ..... 335/47
7,402,279 B2 * 7/2008 Schembri ..... 422/504
7,488,908 B2 * 2/2009 Beerling ..... 200/182
7,735,945 B1 * 6/2010 Sliwa et al. ..... 347/6
2005/0092587 A1 * 5/2005 Wong ..... 200/182
2005/0217741 A1 * 10/2005 Bohm ..... 137/828
2006/0066434 A1 * 3/2006 Richards et al. ..... 337/14
2006/0146466 A1 7/2006 Niayesh et al.
2007/0041138 A1 2/2007 Niayesh et al.
2007/0241856 A1 * 10/2007 Ohtsuka et al. ..... 337/160
2007/0257766 A1 * 11/2007 Richards et al. ..... 337/298
2008/0185057 A1 * 8/2008 Prakash et al. ..... 137/594
2009/0115565 A1 * 5/2009 Watanabe et al. ..... 337/114

FOREIGN PATENT DOCUMENTS

GB 2192057 A * 12/1987
WO WO 00-46828 8/2000

* cited by examiner

MICRO-FLUIDIC BUBBLE FUSE

CROSS-REFERENCE TO RELATED APPLICATIONS

This application is a continuation of PCT Patent Application No. PCT/2008/081245, filed Oct. 27, 2008, entitled Micro-Fluidic Bubble Fuse, which claims priority to U.S. Provisional Patent Application No. 61/000,546, filed Oct. 26, 2007, entitled Micro-Fluidic Bubble Fuse, the content of each of which is hereby incorporated herein by reference.

BACKGROUND OF THE INVENTION

1. Field of the Invention

The present invention relates to a method and apparatus for implementing a microfuse using microfluidics.

2. Description of the Related Art

Many small electronic devices, such as cellular phones and other devices, require fuses to protect their internal circuitry from being exposed to excessive voltage or current. When a fuse is exposed to excessive voltage/current, it will sever the electrical connection to the protected circuitry to thereby isolate the protected circuitry of the device from being exposed to excessive electrical conditions. Conventionally, fuses have been made of thin electrical wires that may be severed when exposed to particular electrical conditions. For example, if the current or voltage exceeds a particular threshold, the thin wire will break causing the flow of electricity through the fuse to cease. These types of fuses are not able to be reset, and hence must be manually replaced. Repair of an electrical device to replace the fuse is time consuming and may be expensive if required to be performed by a professional. Additionally, where the fuse is implemented in a consumer electronic device such as a cellular telephone, Personal Data Assistant (PDA) or laptop computer, replacement of a fuse may represent a major inconvenience to the owner of the affected device.

SUMMARY OF THE INVENTION

A microfluidic bubble fuse is formed from a hermetically sealed reservoir containing an electrically conductive liquid. The reservoir is interposed between a pair of electrodes such that each electrode is in electrical contact with the fluid within the reservoir, and such that the fluid within the reservoir provides electrical interconnectivity between the electrodes. The reservoir may be implemented on a substrate or may be formed from a non-electrically conductive tube such as a glass tube. When the current or voltage across the electrodes increases beyond a threshold, the excess current or voltage will cause a bubble to be created within the fluid to reduce or inhibit the flow of electricity between the electrodes. When the current/voltage is reduced, the bubble will collapse to restore the flow of electricity between the electrodes.

BRIEF DESCRIPTION OF THE DRAWINGS

Aspects of the present invention are pointed out with particularity in the appended claims. The present invention is illustrated by way of example in the following drawings in which like references indicate similar elements. The following drawings disclose various embodiments of the present invention for purposes of illustration only and are not intended to limit the scope of the invention. For purposes of clarity, not every component may be labeled in every figure. In the figures:

DETAILED DESCRIPTION

The following detailed description sets forth numerous specific details to provide a thorough understanding of the invention. However, those skilled in the art will appreciate that the invention may be practiced without these specific details. In other instances, well-known methods, procedures, components, protocols, algorithms, and circuits have not been described in detail so as not to obscure the invention.

Passing electricity through a fluid between electrodes may cause the formation of a bubble. This is phenomenon will be referred to herein as electrolytic bubble formation. Electrolytic bubble formation is well known in the art, and has been documented in connection with use as a micropump, as described in a paper by D. Ateya, et al. entitled "An Electrolytically Actuated Micropump", which was published in April of 2004, the content of which is hereby incorporated herein by reference. Specifically, D. Ateya describes the physics of bubble formation in section II of this paper and then provides a description of how bubble formation may be used to implement a micropump. Bubble formation and collapse, and fluid selection considerations, have also been described in connection with implementation of a bubble valve. One such valve is described in a paper by S. HUA, et al., entitled "Microfluidic Actuation Using Electrochemically Generated Bubbles," which was published in 2002. The copy of this paper is also incorporated herein by reference. Since electrolytic bubble formation is itself known to those skilled in the art, additional information associated with the physics of electrolytic bubble formation will not be described in greater detail herein.

Applicant discovered that electrolytic bubble formation may be used to implement an electrical fuse to isolate electrical components upon application of an elevated electrical current/voltage. The microfuse has the advantage over other types of fuses in that it will automatically reset itself upon removal of the elevated electrical current/voltage upon collapse of the bubble.

The manner in which the reservoir is designed and the fluid selected for use in the microfuse may be implemented by taking into account some of the bubble formation and bubble collapse mechanisms described in these two papers. However, the particular design of the microfuse will also depend on other consideration such as voltage and current levels to be passed/protected by the microfuse.

Figure 1A:
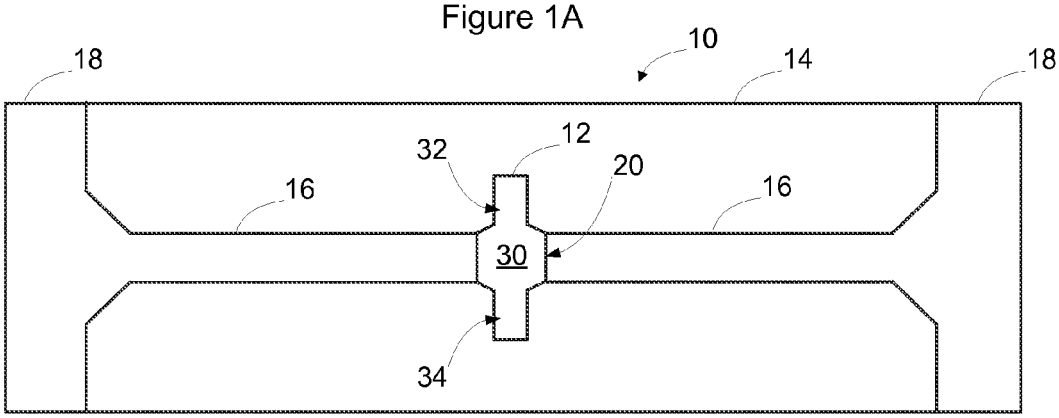
FIGS. 1A and 1B are a top view and perspective view of an example fuse including a microfluidic chamber during normal operating conditions according to an embodiment of the invention.
Figure 1B:
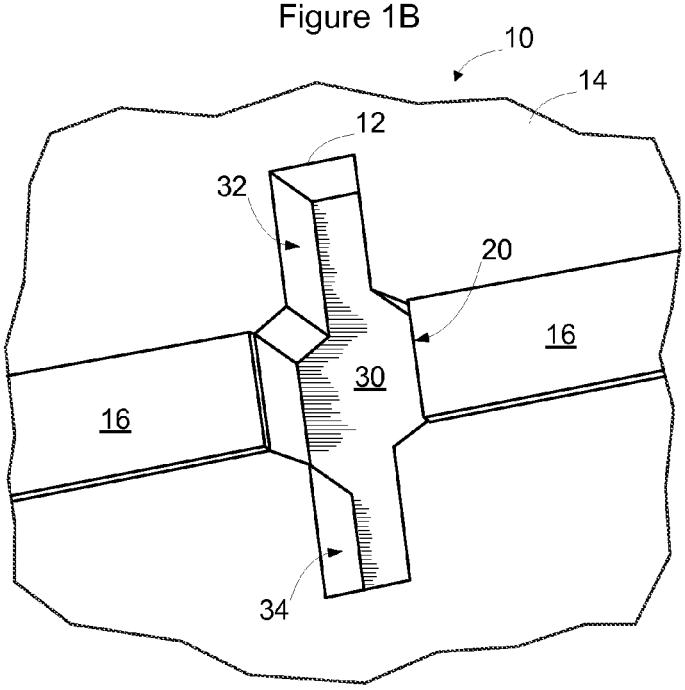

FIGS. 1A and 1B show an example microfluidic bubble fuse according to an embodiment of the invention during normal operation in which excess current/voltage is not applied to the fuse. As shown in FIGS. 1A and 1B, a fuse 10 may be formed by etching or otherwise creating a confined reservoir 12 in a substrate such as an industry standard silicon substrate. The confined reservoir has a specified volume that is defined on five sides by the substrate. The confined nature of the reservoir prevents fluid from entering or leaving the reservoir once sealed. A fluid will be contained within the reservoir 12 and sealed within the reservoir by application of a top sealing material. The reservoir is thus hermetically sealed.

A pair of electrodes 16 are formed on/in the substrate to extend from a contact region 18 to the reservoir. The end 20 of each electrode 16 extends to the reservoir to enable the electrode to contact the fluid in the reservoir. The electrodes may be formed from gold, platinum, rhodium, or other non-corrosive and electrically conductive material. A material is used to hermetically seal the reservoir. For example, polydimethylsiloxane (PDMS) may be used to hermetically seal the reservoir. PDMS is commonly available in thin sheet form such as a film, although other materials may be used as well. The sealing material is placed and adhered to the top of the substrate to seal the reservoir and maintain the liquid within the reservoir in contact with the electrodes.

Figure 2A:
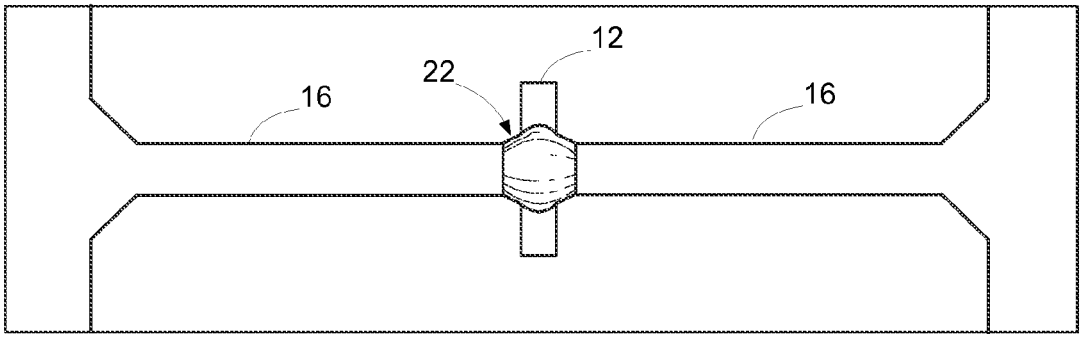
FIGS. 2A and 2B are a top view and perspective view of the fuse of FIG. 1 under high voltage/current conditions showing bubble formation within the microfluidic chamber according to an embodiment of the invention.
Figure 2B:
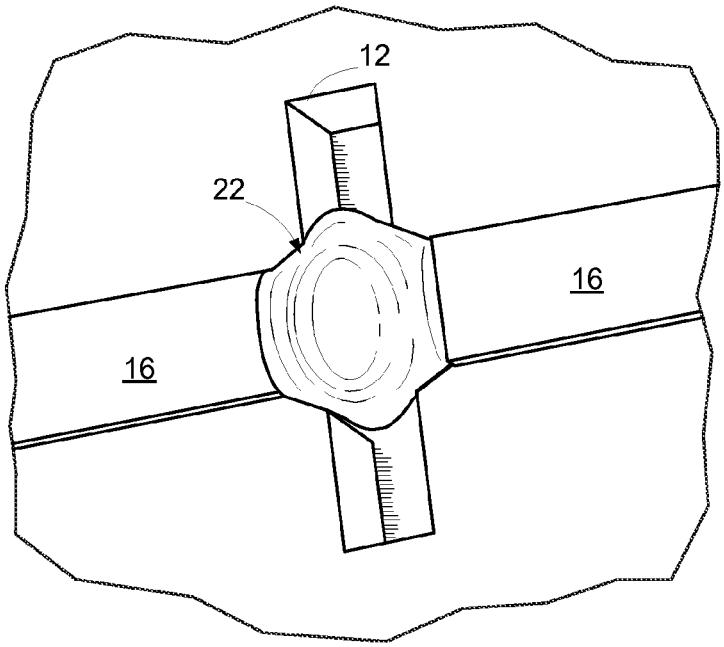
Figure 3A:
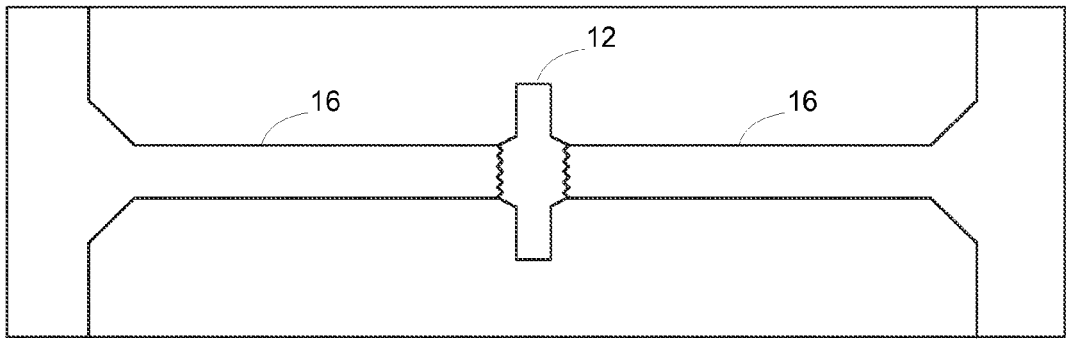
FIGS. 3A and 3B show a top view and perspective view of an example fuse having a sawtooth electrode configuration according to an embodiment of the invention.
Figure 3B:
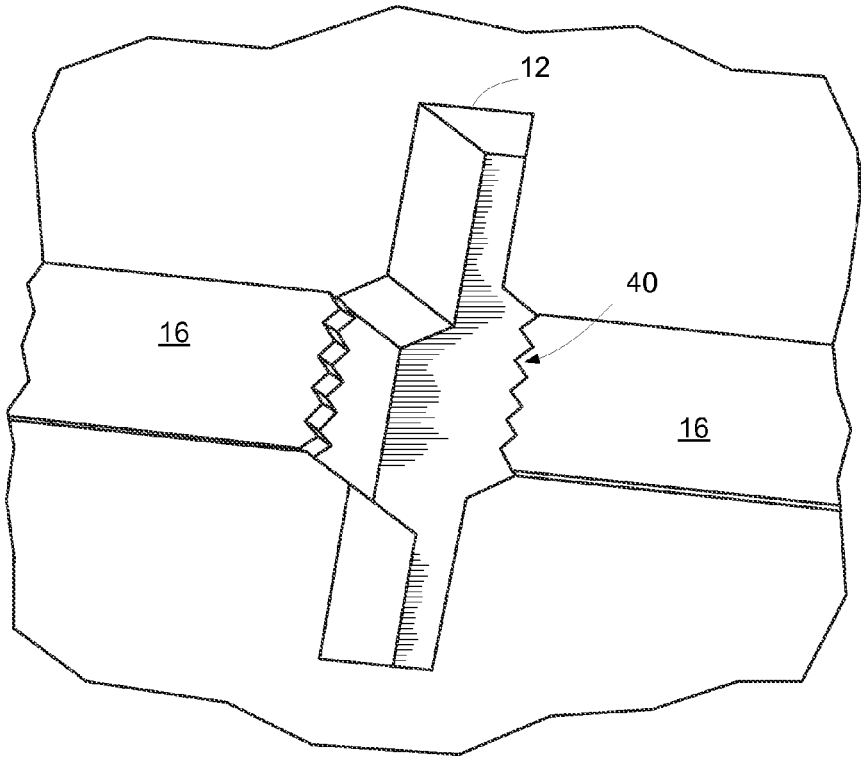
Figure 11:
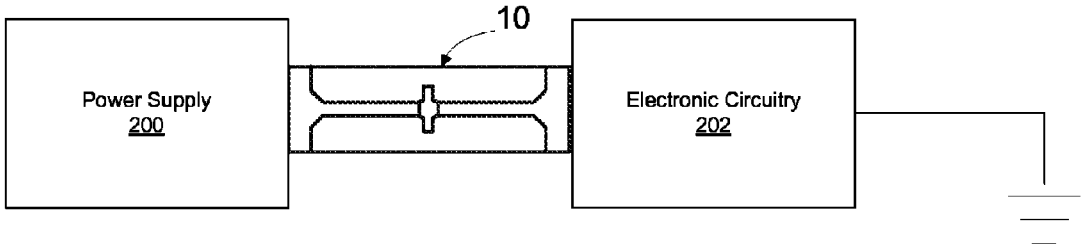
FIG. 11 is a view of an example microfluidic bubble fuse protecting an electronic circuit.

FIGS. 2A and 2B show the example microfluidic bubble fuse of FIGS. 1A and 1B in operation upon formation of a bubble 22 within the reservoir 12. As is known in the art, application of a voltage through a liquid will cause formation of a bubble to occur. Formation of the bubble will decrease the amount of current that can be transferred between the electrodes 16. Hence, the bubble fuse may be used to protect electronic circuitry against overcurrent conditions. For example, as shown in FIG. 11, the microfluidic bubble fuse may be used to connect electronic circuitry to a power supply such that, in the event of an unexpected power surge, the electronic circuitry may be protected.

In normal operation, the bubble fuse will allow electrical current to flow between the metal electrodes 16 through the electrically conductive fluid in the reservoir. The electrically conductive fluid may be water, a saline solution, acidic solution, or another fluid, that enables electrolytic bubble formation to occur.

As the voltage increases, an electrolytic bubble will form between the electrodes to increase the resistance between the electrodes and, hence, to reduce or inhibit the flow of electricity between the electrodes. FIG. 2 shows an example bubble. As the current or voltage exceeds the particular value, a bubble is created (nucleated) due to the input voltage or current creating an electrochemically formed gas bubble. When this happens the bubble reduces the flow of electricity through the fuse. As the electric field is reduced, the bubble will collapse to restore the flow of electricity through the fuse. Thus, the fuse is not only able to protect the electronic circuitry from unexpected power conditions, it is also automatically resettable and reusable.

As mentioned above, a film such as a polydimethylsiloxane (PDMS) film is placed on top of the substrate to seal the reservoir containing the fluid within the reservoir in the substrate. Optionally, the film may cause pressure in the fluid in the closed reservoir to increase upon formation of the bubble to thereby prevent formation of bubbles at lower voltages and accelerate collapse of the bubble upon removal of the excess voltage/current.

The voltage and current properties of the fuse will be characterized by the width of the gap, properties of the solution, volume of solution, diffusion rate, resistivity of solution, electrode material properties, surface area of electrode, surface topography of electrode, and possibly other factors. Also many of these variables can be optimized for response time, different outcomes form varying inputs, at what voltage or current or both will the bubble form. Larger volumes will equate to longer response times and smaller volumes will result in shorter response times, parallel to this is also gap width, solution properties, electrode surface area etc.

In the embodiment shown in FIGS. 1A-1B and 2A-2B, the reservoir 12 is shaped to have a bubble formation region 30 and a pair of expansion regions 32, 34. The bubble formation region may be approximately octagonal, having a pair of tapered side-walls connecting the bubble formation region with each of expansion regions. The reservoir at the bubble formation region may be approximately 25 um wide and 25 um deep. The length of the reservoir, including the bubble formation region and 30 and expansion regions 32, 34, may be on the order of 75 um. Other dimensions may be used as well. The ends of the electrodes may end flush with the bubble formation region 30 or may extend part way into the bubble formation region to ensure adequate contact with the electrolytic fluid contained within the reservoir. Although these are example dimensions, the dimensions may be varied to enable formation of a bubble to occur only when the voltage across the electrodes exceeds a predefined value.

Figure 4A:
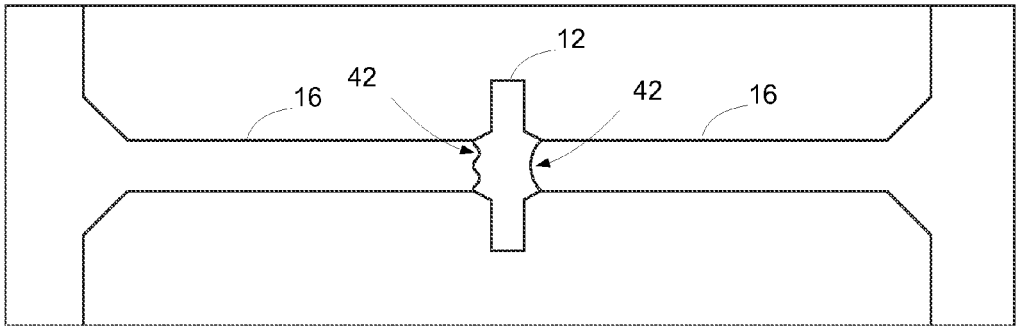
FIGS. 4A and 4B show a top view and perspective view of an example fuse having a undulating electrode configuration according to an embodiment of the invention.
Figure 4B:
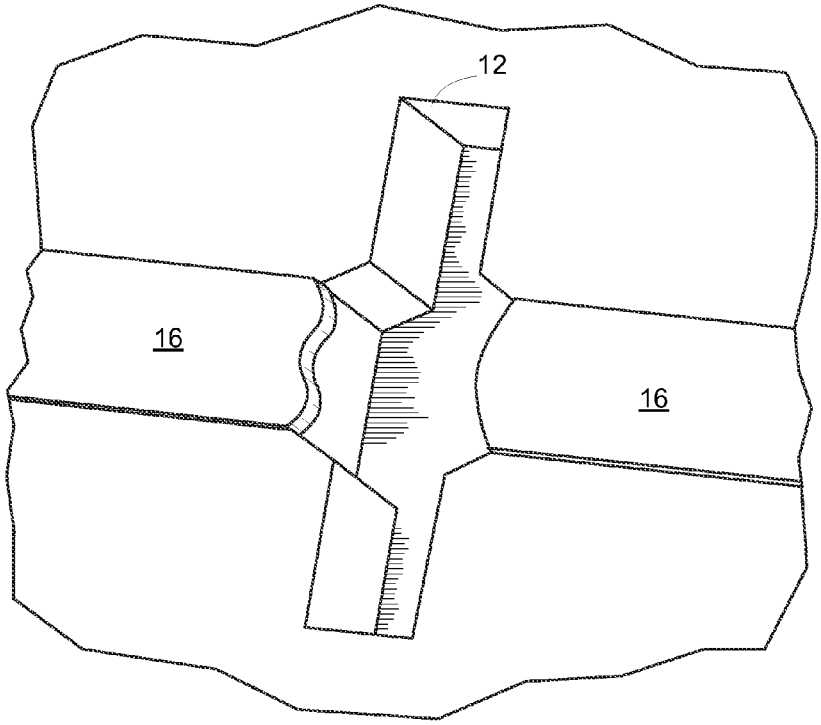

FIGS. 3A-3B, and 4A-4B show two alternative configurations in which the ends of the electrodes are modified to encourage selective bubble formation. For example, in FIGS. 3A-3B, the ends of the electrodes are serrated to have points 40. Alternatively, as shown in FIGS. 4A-4B, the ends of the electrodes may undulate to form one or more bumps 42 that protrude into the bubble formation region.

Figure 5A:
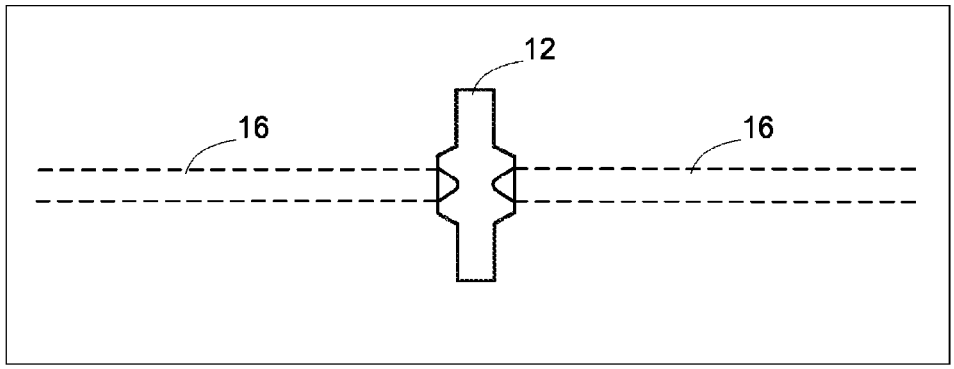
FIGS. 5A and 5B show a top view and perspective view of an example fuse having a conical electrode configuration according to an embodiment of the invention.
Figure 5B:
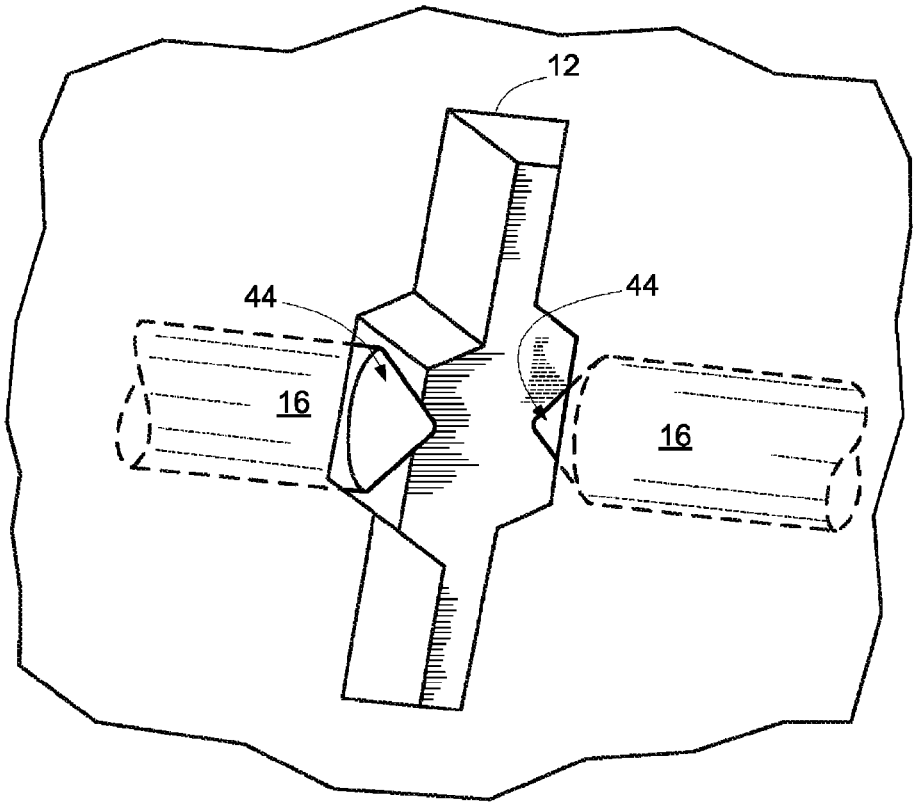

FIGS. 5A-5B show another embodiment in which the electrodes are formed to have conical ends 44 that protrude into the reservoir. The conical ends may be formed on the ends of wire s forming the electrodes 16. In this embodiment, the wires may be disposed on a printed circuit board and soldered or otherwise held in place to extend to face each other across the reservoir.

FIGS. 6-9 show several examples of a fuse 10 in cross-section. As shown in these Figs. a fuse 10 may be formed by etching a reservoir 12 in a substrate 14. The substrate may be a silicon substrate or may be formed of another material. Many techniques are commonly used to process silicon substrates to form desired structures on the substrate and the invention is not limited by the particular manufacturing techniques used to create the reservoir on the substrate, or to the particular substrate selected to implement the fuse.

Figure 6:
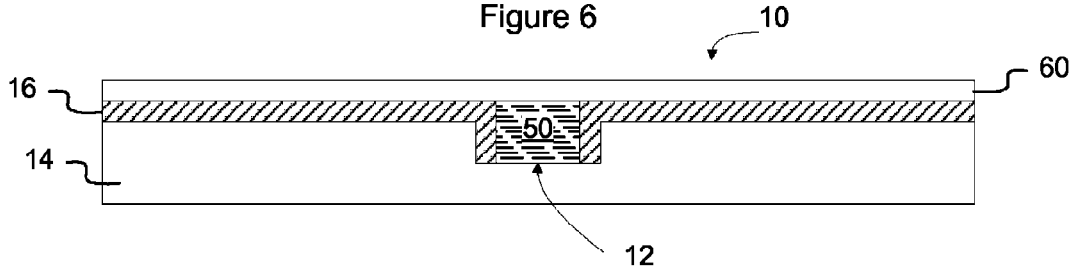
FIGS. 6-9 are cross-sectional views of several example fuse configurations.
Figure 7:
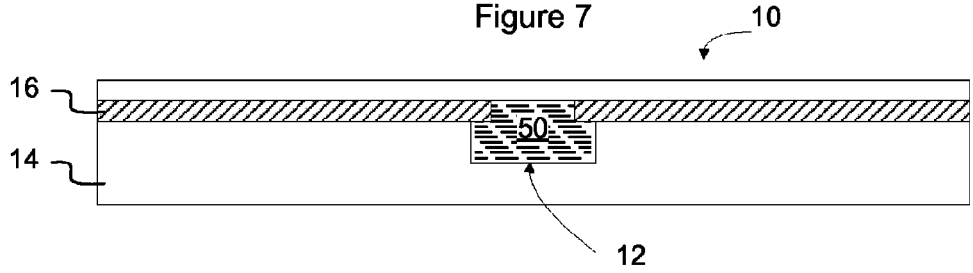
Figure 8:
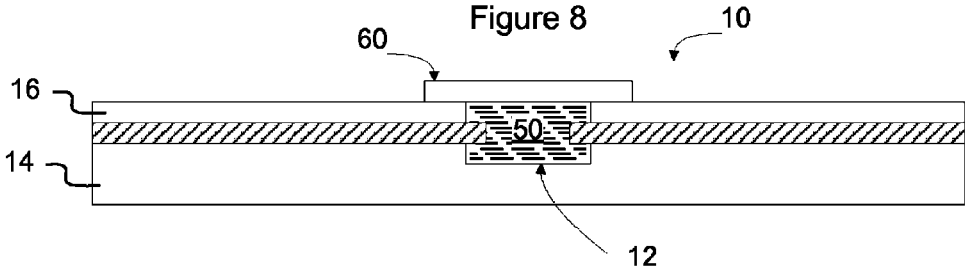
Figure 9:
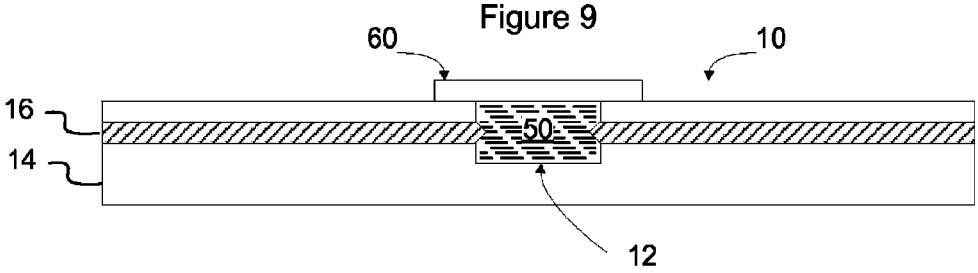

Electrodes 16 are formed on either side of the reservoir 12 to terminate adjacent the reservoir or on an inner surface of the reservoir 12. In the example shown in FIG. 6, the electrodes are configured to wrap down along the inner surface of the reservoir to protrude down into the reservoir. In the example shown in FIG. 7, the electrodes extend into the reservoir a particular distance to increase contact between the contacts and the fluid 50 in the reservoir. In the embodiment shown in FIG. 7, the electrodes are disposed on the top surface of the substrate. In the embodiment shown in FIG. 8 the electrodes are formed within the substrate to enter the reservoir part way between the top surface and bottom surface of the reservoir. In the embodiment shown in FIG. 9, the ends of the electrodes are pointed in a manner similar to that shown in FIGS. 5A-5B. Many such geometrical modifications may be made to the fuse. The reservoir may be hermetically sealed by overlaying a sealing material on the entire substrate as shown in FIGS. 6 and 7, or may be hermetically sealed by overlaying a sealing material on the region directly surrounding the reservoir as shown in FIGS. 8 and 9.

The particular geometry of how the electrodes extend into and around the reservoir may depend on the characteristics of the liquid, the size of the reservoir, the intended voltage levels of the fuse, and other similar characteristics. To enable the flow of electricity to be terminated or controlled upon formation of a bubble, the electrodes are configured in/around the reservoir in a manner such that they do not contact each other.

An electrically conductive fluid 50 is disposed in the reservoir 12 and a top surface, such as a film 60 formed from a material such as polydimethylsiloxane or other material is disposed or placed and sealed on the electrodes and/or substrate to seal the reservoir and prevent the fluid from escaping the reservoir. In normal operation, the electrically conductive fluid provides an electrically conductive path between the electrodes to allow normal flow of electricity to occur between the electrodes. Upon application of an excessive electrical field, however, a bubble will nucleate on one or more of the surfaces of the electrodes to fill the space within the reservoir between the electrodes. The bubble will displace the electrically conductive liquid to prevent further flow of electricity between the electrodes.

There are several ways to enable the bubble to displace the electrically conductive liquid. For example, the material that hermetically seals the reservoir may be flexible and act as a diaphragm to enable the volume of the reservoir to increase temporarily upon creation of the bubble. Depending on the size of the bubble formation region, the expansion regions may be sized to accommodate the expected volume of the bubble, given the amount of flexure of the diaphragm.

Alternatively, the reservoir may be only partially filled with liquid to provide an air gap within the reservoir. The air gap within the reservoir will provide space for the liquid to be displaced upon formation of the air bubble. Where the reservoir is partially filled, the depth of the reservoir in the expansion regions may be adjusted to preferentially cause liquid to remain in the bubble formation region under normal operating conditions. Another way of providing an air gap may be to have a second set of electrodes generating a secondary bubble at another location within the reservoir, such as within one of the expansion regions. In this embodiment, when a primary bubble forms in the bubble formation region, the formation of that bubble may cause the secondary bubble formed in the expansion region to collapse to thereby enable a primary bubble to form without significantly increasing the overall pressure within the reservoir.

Figure 10:
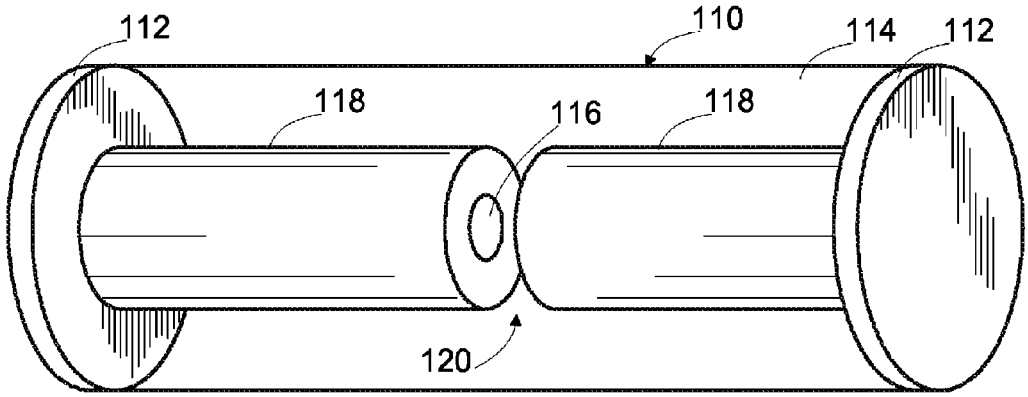
FIG. 10 is a perspective view of a tubular fuse with a microfluidic bubble fuse mechanism according to an embodiment of the invention.

FIG. 10 shows another embodiment of the invention in which the microfluidic bubble fuse is formed as a Bussman fuse. As shown in FIG. 10, the fuse 110 has a pair of electrical contacts 112 on each of the ends of a tube 114. The tube may be formed from glass or other material that is not electrically conductive. Electrodes 116 extend within insulators 118 to face each other across a gap 120. An electrically conductive fluid is used to fill or partially fill the tube before the tube is hermetically sealed. In connection with this, optionally the tube may be only partially sealed such as 60% filled to enable an expansion region to be formed so that creation of a bubble between the electrodes will cause less of an increase in pressure in the tube. During normal operating conditions, the electrically conductive fluid will enable electricity to pass between the electrodes 116 to thereby enable the fuse to conduct electricity to the electrical circuitry being protected. If higher electrical conditions are encountered, however, a bubble will be formed between the electrodes to inhibit the flow of electricity through the fuse.

FIG. 11 shows an example of the microfluidic bubble fuse in operation. As shown in FIG. 11, the microfluidic bubble fuse 10 may be used to protect an electrical circuit 200 by interposing the microfluidic bubble fuse between a power supply 202 and the electrical circuit 200.

Figure 12:
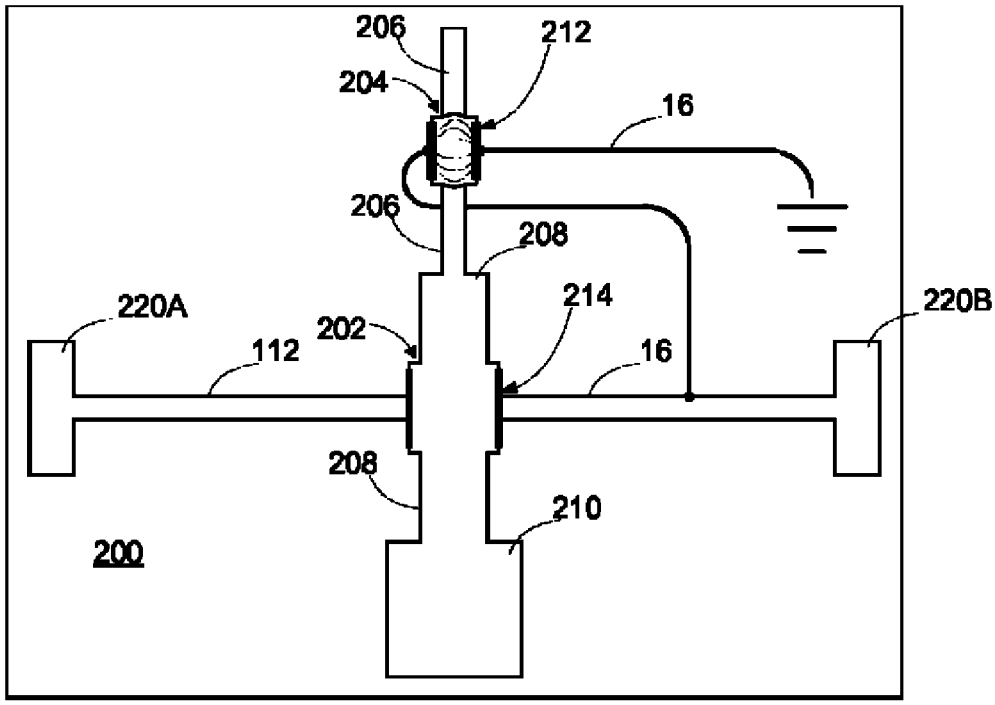
FIG. 12 is a top view of an example fuse according to another embodiment in normal operation showing bubble formation in a secondary bubble formation chamber.
Figure 13:
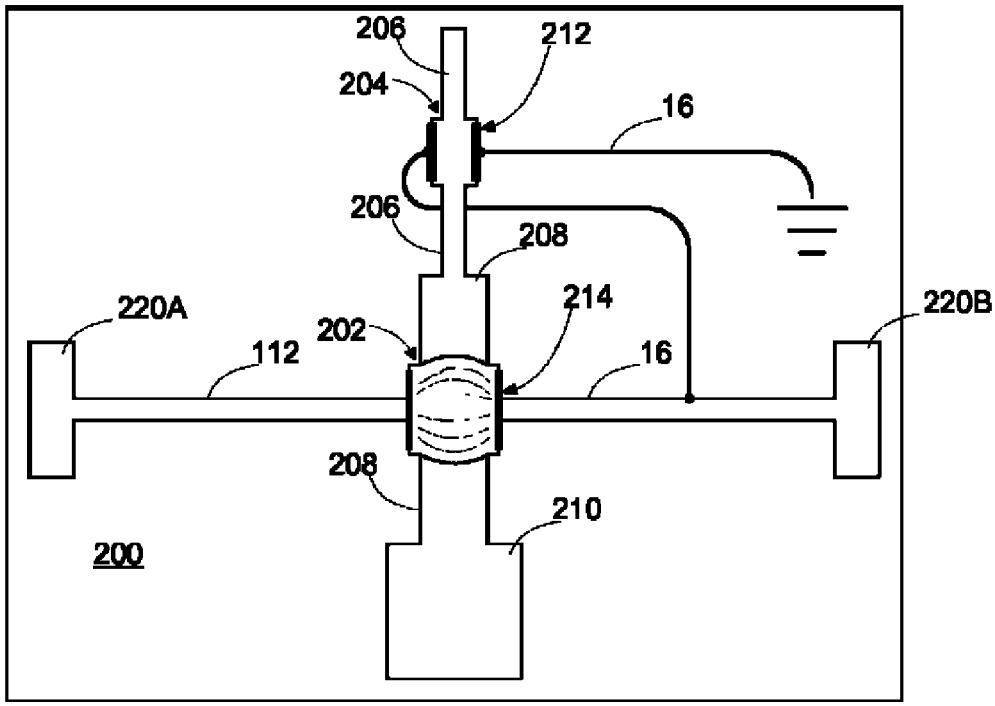
FIG. 13 is a top view of the example fuse of FIG. 12 under high voltage/current conditions showing bubble formation in a primary bubble formation chamber.

FIGS. 12 and 13 show another embodiment in which a microfluidic bubble fuse 200 has two bubble formation chambers—a primary bubble formation chamber 202 and a secondary bubble formation chamber 204. The secondary bubble formation chamber is flanked with expansion areas 206, and the primary bubble formation chamber is flanked with expansion areas 208. One of the expansion areas of the primary bubble formation chamber is in hydraulic communication with one of the expansion areas of the secondary bubble formation chamber to allow fluid to pass there between. An expansion chamber 210 is also provided in hydraulic communication with one of the expansion areas of the primary bubble formation chamber. Other configurations may be implemented as well.

During normal operation, electrical current applied to contact 220 is passed to electrodes 214 in the primary bubble formation chamber. The geometry and fluid in the primary bubble formation chamber are selected such that a bubble will not form between the electrodes in the primary bubble formation chamber during normal operation. Accordingly, electrical current will flow through the liquid in the primary bubble formation chamber during normal operation, thus enabling a circuit connected to contact 220B to be operated.

During normal operation, electrical conditions present on contact 220B are also connected to one of the electrodes 212 on secondary bubble formation chamber. The other electrode of secondary bubble formation chamber is connected to ground. The geometry and other parameters of the secondary bubble formation chamber are set such that a bubble will form in the secondary bubble formation chamber during normal operating conditions. This scenario is shown in FIG. 12.

When the voltage/current on contact 220A increases sufficiently, the increase in voltage will cause a bubble to form in the primary bubble formation chamber 202. This will cause a drop-off in current on contact 220B. The drop-off in current on contact 220B will cause the bubble in the secondary formation chamber 204 to collapse. Hence, in this embodiment, occurrence of an overcurrent/overvoltage condition will cause the near simultaneous generation of a bubble in the primary bubble formation chamber and collapse of a bubble in the secondary bubble formation chamber. Since these bubble formation chambers are connected, the net change in volume required to accommodate the generation of the bubble in the primary formation chamber may be reduced to thereby minimize the change in pressure within the reservoir associated with generation of the bubble to protect the attached electronic circuits.

FIG. 13 shows the embodiment of FIG. 12 in the presence of a high current/voltage. As shown, when a bubble is generated in the primary bubble formation chamber, the current/voltage on the contact 220B is reduced. This reduction in current/voltage causes a drop in current/voltage on the secondary electrodes 212 associated with the secondary bubble formation chamber, which enables the bubble in the secondary bubble formation chamber to collapse. Collapsing the bubble in the secondary formation chamber provides volume and, hence a reduction in pressure, which may enable faster formation of a bubble in the primary bubble formation chamber. Collapsing the bubble in the secondary formation chamber further provides a connection between connector 220B and ground, to further protect the electronic circuitry from the overcurrent/overvoltage conditions on contact 220A.

In the embodiment shown in FIGS. 12 and 13, the primary and secondary bubble formation chambers are connected to a single pair of contacts. Alternatively, separate pairs of contacts may be used to control bubble formation in these chambers. Additionally, in the embodiment shown in FIGS. 12 and 13 an expansion chamber has been shown attached to the reservoir. The expansion chamber holds a mass of liquid that is in hydrodynamic communication with the rest of the reservoir. When the reservoir is overlaid by a diaphragm, the expansion chamber has a large top surface area that is in contact with the diaphragm. When a bubble is formed, the volume of liquid displaced by the bubble formation may pass into the expansion chamber, causing displacement of the diaphragm. Since the expansion chamber has a greater surface area in contact with the diaphragm, the diaphragm of the expansion chamber will not need to flex as much to accommodate a given bubble volume. Hence, providing the reservoir with an expansion area may enable faster bubble formation with less increase in pressure and less diaphragm flexure than would be possible using a smaller liquid volume.

It should be understood that various changes and modifications of the embodiments shown in the drawings and described in the specification may be made within the spirit and scope of the present invention. Accordingly, it is intended that all matter contained in the above description and shown in the accompanying drawings be interpreted in an illustrative and not in a limiting sense. The invention is limited only as defined in the following claims and the equivalents thereto.

What is claimed is:

1. A microfluidic bubble fuse, comprising:

a substrate having a hermetically sealed reservoir defined therein and containing an electrically conductive fluid disposed therein; and a pair of electrodes terminating on either side of the hermetically sealed reservoir, each of the pair of electrodes being in contact with the electrically conductive fluid disposed within the hermetically sealed reservoir but not directly in contact with each other such that electrical connectivity between the electrodes requires electricity to pass from one of the electrodes, through the electrically conductive fluid, to the other electrode;

wherein, upon application of an electrical field across the electrodes in excess of expected electrical operating conditions a bubble will form in the electrically conductive fluid to reduce the flow of electricity between the electrodes.

2. The microfluidic bubble fuse of claim 1, wherein the hermetically sealed reservoir is defined as a reservoir within the substrate, and a film is used to hermetically seal the reservoir with the electrically conductive fluid disposed therein.

3. The microfluidic bubble fuse of claim 2, wherein the film is a polydimethylsiloxane film.

4. The microfluidic bubble fuse of claim 1, wherein each of the electrodes extends a particular distance into the hermetically sealed reservoir.

5. The microfluidic bubble fuse of claim 1, wherein at least one end of one of the electrodes is serrated to form points.

6. The microfluidic bubble fuse of claim 1, wherein at least one end of one of the electrodes is undulated to form at least one bump.

7. The microfluidic bubble fuse of claim 1, wherein both ends of the electrodes are undulated to form at least one bump on each electrode.

8. The microfluidic bubble fuse of claim 1, wherein the substrate is silicon.

9. The microfluidic bubble fuse of claim 1, further comprising a second pair of electrodes terminating on either side of the hermetically sealed reservoir, each of the electrodes of the second pair being in contact with the electrically conductive fluid disposed within the hermetically sealed reservoir but not directly in contact with each other such that electrical connectivity between the electrodes requires electricity to pass from one of the electrodes, through the electrically conductive fluid, to the other electrode.

10. The microfluidic bubble fuse of claim 9, wherein during normal operation a second bubble will be formed between the second pair of electrodes.

11. The microfluidic bubble fuse of claim 10, wherein, upon application of the electrical field across the first pair of electrodes in excess of expected electrical operating conditions causing formation of the bubble between the first pair of electrodes, the second bubble will collapse.

12. The microfluidic bubble fuse of claim 1, wherein the reservoir is defined in the substrate as a confined region having a volume and which is defined on a plurality of sides by the substrate.

13. The microfluidic bubble fuse of claim 12, wherein the reservoir is defined on five sides by the substrate.

14. The microfluidic bubble fuse of claim 1, wherein the hermetically sealed reservoir includes a bubble formation region defined in the substrate.

15. The microfluidic bubble fuse of claim 1, wherein the substrate is a silicon substrate, and wherein the reservoir is defined within the silicon substrate by etching the substrate.

16. The microfluidic bubble fuse of claim 1, wherein the substrate has a top surface, and wherein the reservoir has a bottom surface disposed below the top surface, the reservoir being open from the reservoir bottom surface to the substrate top surface to define a bubble formation region, the microfluidic bubble fuse further including a hermetic seal disposed on the top surface of the substrate to span the reservoir.

17. A method of protecting an electrical circuit from an over-current condition, the method comprising the steps of:

creating a reservoir in a substrate;

forming electrodes on the substrate to contact the reservoir;

filling the reservoir with an electrically conductive liquid;

hermetically sealing the electrically conductive liquid in the reservoir; and interposing the reservoir in an electrical path between a power source terminal and an electrical circuit, so that, in operation, the electrically conductive liquid will help protect the electrical circuit from an overcurrent condition;

wherein the reservoir is formed in the substrate as a recessed region forming a bubble chamber, the recessed region being adapted to hold the electrically conductive liquid such that, upon occurrence of the overcurrent condition, a bubble will form in the electrically conductive liquid to help protect the electrical circuit from the overcurrent condition.

* * * * *